US005987789A

United States Patent [19]

Lubina

[11] Patent Number: 5,987,789

[45] Date of Patent: Nov. 23, 1999

[54] STITCHERY STAND AND FRAME

[76] Inventor: John R. Lubina, 7 Marjorie Ct., Bear, Del. 19701

[21] Appl. No.: 09/036,697

[22] Filed: Mar. 9, 1998

[51] Int. Cl.[6] ..... D06C 3/08

[52] U.S. Cl. ..... 38/102.4; 38/102.1; 38/102.91

[58] Field of Search ..... 38/102.4, 102.1, 38/102.21, 102.91; 160/371, 372, 378, 380, 381, 391, 392

[56] References Cited

U.S. PATENT DOCUMENTS

| | | | |
|---|---|---|---|
| D. 276,162 | 10/1984 | Rancourt . | |
| 351,667 | 10/1886 | Squire . | |
| 2,447,346 | 8/1948 | Krantz | 160/381 |
| 2,884,737 | 5/1959 | Lamme | 38/102.21 |
| 3,303,936 | 2/1967 | Barnawell . | |
| 3,559,316 | 2/1971 | Galper | 38/102.91 |
| 3,938,267 | 2/1976 | Bard . | |
| 3,955,511 | 5/1976 | Bak . | |
| 3,980,026 | 9/1976 | Thomas . | |
| 4,102,065 | 7/1978 | Selden . | |
| 4,229,890 | 10/1980 | Dropinski . | |
| 4,292,748 | 10/1981 | Miller . | |
| 4,322,901 | 4/1982 | Spitzke . | |
| 4,375,197 | 3/1983 | Hinson | 38/102.1 X |
| 4,539,734 | 9/1985 | Messerschmitt . | |
| 4,665,638 | 5/1987 | Morton . | |
| 4,769,934 | 9/1988 | Dolce . | |
| 4,944,105 | 7/1990 | Schulle | 38/102.4 |
| 4,947,561 | 8/1990 | Delacroix et al. . | |
| 5,133,140 | 7/1992 | Frey . | |
| 5,271,171 | 12/1993 | Smith . | |
| 5,274,934 | 1/1994 | Newman . | |
| 5,351,424 | 10/1994 | Schulle et al. | 38/102.1 |
| 5,502,906 | 4/1996 | Yamawaki . | |
| 5,579,595 | 12/1996 | Dutton | 38/102.1 |

FOREIGN PATENT DOCUMENTS

| | | |
|---|---|---|
| 482872 | 4/1952 | Canada . |
| 2479861 | 10/1981 | France . |
| 41 39 756 | 6/1993 | Germany . |
| 818920 | 5/1981 | U.S.S.R. . |

*Primary Examiner*—Ismael Izaguirre

*Attorney, Agent, or Firm*—Connolly Dove Lodge & Hutz LLP

[57] ABSTRACT

A stitchery stand and frame assembly includes a stand having spaced posts which are connected together at their lower ends by a box assembly into which a tongue is slidably mounted. A frame unit connects the upper end of the posts. The frame unit includes a working frame wherein the side members and spanning members are connected together by being inserted into corner connectors. A fabric is mounted in a peripheral groove of the working frame. A mounting frame is mounted against the working frame.

36 Claims, 8 Drawing Sheets

STITCHERY STAND AND FRAME

BACKGROUND OF THE INVENTION

1. Field of the Invention

The present invention relates to a stitchery stand and frame for holding fabric or similar material in a stretched condition and more particularly to holding fabric used for needlepoint, embroidery, painting, printing, decoration or the like.

2. Description of Related Art

During the course of needlework, fabric to which the needlework is being applied tends to warp or distort. It is desirable to maintain the fabric in a stretched condition with tension evenly applied from all edges of the fabric to minimize this distortion. It is desirable to rigidly support the fabric to provide a stable working surface. It is desirable to provide an apparatus for holding the fabric which is as light as possible while maintaining adequate rigidity. It also is desirable to allow the fabric to be easily attached and detached from the apparatus. It is desirable to maintain the apparatus at a convenient working height and to provide a wide range of adjustment to accommodate fabric of different dimensions. It is desirable to be able to transfer the finished needlework for display with a minimum of additional steps, such as dry cleaning.

Widely in use for needlework are small hand-held frames in which fabric is clamped between inner and outer hoops. Such frames do not provide easy access to more than one side of the workpiece and require frequent releasing and clamping to accommodate large workpieces. The repeated clamping and releasing may result in uneven stretching and distortion of the workpiece. Also in use are frames utilizing two rollers to hold and tension the fabric. See, for example, French patent No. 2479861 issued Oct. 9, 1981 to M. Genovesi. Such frames allow tension to e applied only to two edges of the fabric with the remaining two edges being unsupported. The two-roller frames do not prevent, and in fact may promote, distortion of the fabric and do not provide a fully stable working surface.

U.S. Pat. No. 4,322,901 issued Apr. 6, 1981 to A. Spitzke entitled "Needlework Frame", described a frame having grooves with multiple elements clamping the fabric into the groove. The mechanism for joining the sides of the frame used in the Spitzke patent and the use of discrete clamping elements preclude the application of continuous tension from all edges of the fabric.

U.S. Pat. No. 4,947,561 issued Aug. 14, 1990 to T. Delacroix "Frame for Cloth or Artistic Canvases" describes a frame for mounting artists' canvasses using a groove and a continuous band clamping the canvas into the groove. The Delacroix patent relates to artists' canvasses rather than to needlework frames, and does not each the use of an external bracket holding and reinforcing the sides of the frame, while allowing access to the band to easily clamp and release the workpiece.

U.S. Pat. No. 5,133,140 issued Jul. 28, 1992 to J. Frey entitled "Frame with Fabric Securing Toothed Strips or Moldings and Method" describes an apparatus for mounting fabric on a board. The apparatus involves a molding having teeth or barbs. U.S. Pat. No. 5,502,906 issued Apr. 2, 1996 to S. Yamawaki entitled "Cloth Fixing Frame with Corner and Cloth fixing Members" describes a frame for holding cloth for painting or embroidery. The frame includes a groove and a fixing means driven through the fabric and into the groove to hold the fabric. The Frey and Yamawaki patents require physical penetration of the fabric with the resulting damage to the fabric.

Prior art examples for stands to support frames for needlework have various shortcomings. Many are accessible only from one side, as in U.S. Pat. No. 351,667 issued Oct. 26, 1886 to E. Squire entitled "Adjustable Embroidery Frame and Stand," U.S. Pat. No. 4,102,065 issued Jul. 25, 1978 to B. Selden entitled "Adjustable Stand for Needlework and the Like" and U.S. Pat. No. 4,665,638 issued May 19, 1987 to O. Morton entitle "Quilting Frame." Others have only obstructed access, as in U.S. Pat. No. 4,229,890 issued Oct. 28, 1980 to M. Dropinski entitled "Picture Making Easel and Frame," and U.S. Pat. No. 4,292,748 issued Oct. 6, 1981 to B. Miller entitled "Clamp Stand for Needlework Frames."

Whatever the merits of the prior art inventions, none teaches or suggests a combination of external reinforcement for the free members, continuous tensioning from each edge of the fabric, and ease of fabric mounting and release. The prior art does not teach or suggest a stand for supporting the apparatus having a combination of sliding adjustment to accommodate different sizes of apparatus, sturdy support and ready access to both the front and back of the fabric.

SUMMARY OF THE INVENTION

A principal object of the invention is to provide a quick and easy means for attaching and removing a fabric workpiece to and from a rigid apparatus, and for holding the fabric on the apparatus in continue, even tension when the fabric is attached.

An additional object of the invention is to provide stable connection of the apparatus elements, while maintaining the ability to attach and remove the fabric from the assembled apparatus.

An additional object is to provide for flexible and adjustable support for a fabric workpiece to allow access to the workpiece and to easily accommodate workpieces of different sizes.

A further object of the invention is to allow a finished workpiece to be transferred from the apparatus with a minimum of additional steps, such as dry cleaning.

In accordance with this invention a stitchery stand and frame assembly includes a stand having a pair of spaced posts. The lower ends of the posts are joined by a connecting unit in the form of a box assembly secured to one post and a tongue secured to the other post for slidably fitting in a slot of the box assembly. A frame unit is mounted between and connected to the upper end of the posts by a swivel connection. The frame unit includes a working frame having a pair of spaced parallel side members disposed adjacent the posts and a pair of spaced parallel spanning members between the side members. Each side member is connected to an adjacent spanning member by a corner bracket to form the four corners of the working frame. The working frame and corner bracket includes fabric mounting structure, preferably a continuous peripheral groove into which the edges of a piece of fabric may be inserted. In a preferred practice of the invention the fabric is held in place in the continuous peripheral groove by splines. A mounting frame is secured over the fabric and continuous groove. The various frame unit components, namely, the working frame and mounting frame are held together by spring clips.

In a preferred practice of the invention the size of the frame could be varied by the detachable assembly of the frame members to the corner bracket so that, for example, a wider or narrower frame could be accommodated by the stand in view of the sliding engagement of the tongue in the box assembly. Preferably, the frame unit is capable of being mounted at different heights to the post by providing a series of holes in the posts into which the swivel pins or bolts which connect the frame to the posts would be inserted. A support bracket may be attached to one of the frames for holding a lamp or the like.

THE DRAWINGS

DETAILED DESCRIPTION

Figure 1:
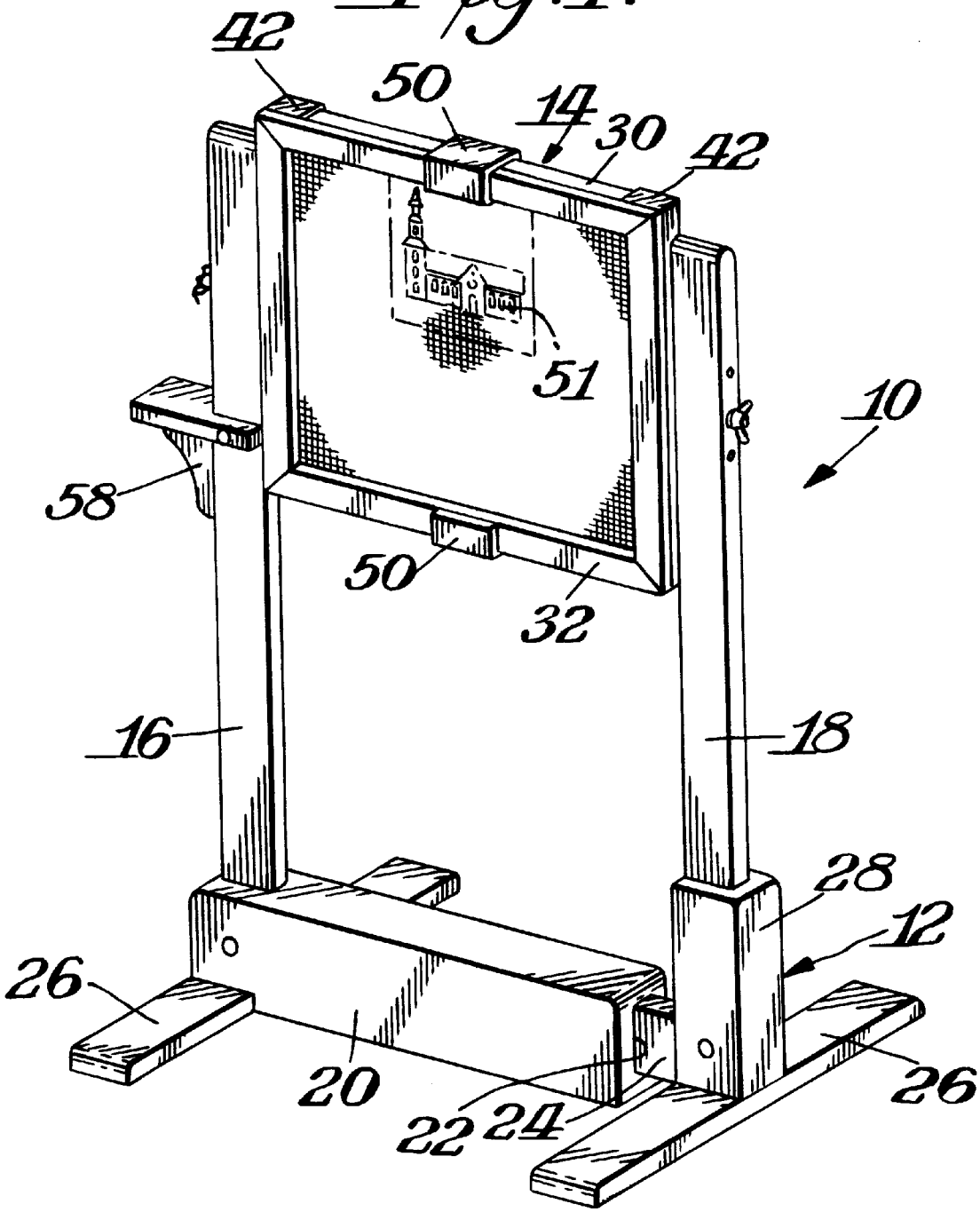
FIG. 1 is a perspective view of a stitchery stand and frame assembly in accordance with this invention.
Figure 2:
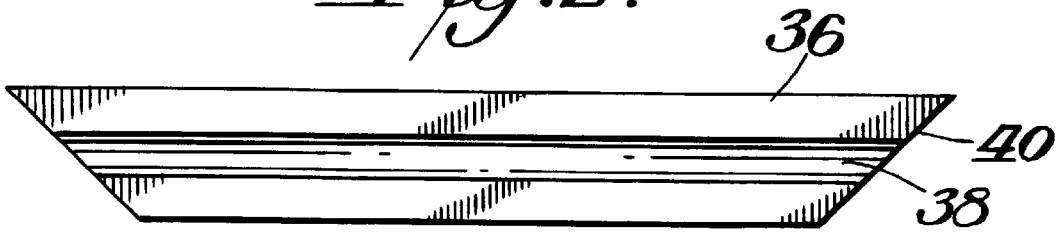
FIG. 2 is a front elevation view of one of the frame members for the frame unit used in the assembly of FIG. 1.
Figure 3:
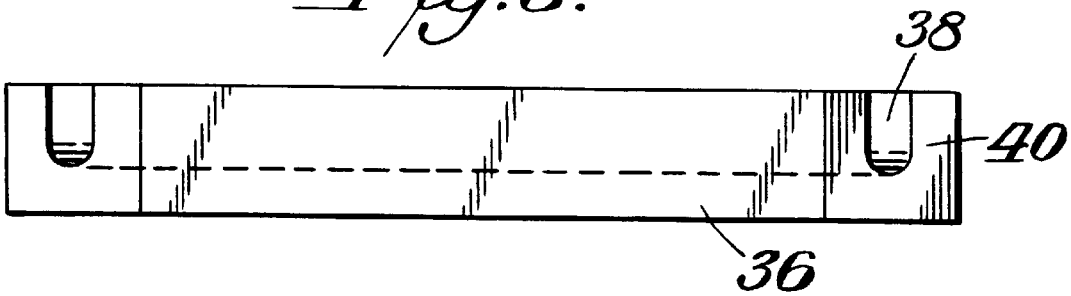
FIG. 3 is a bottom plan view of the frame member shown in FIG. 2.

FIG. 1 illustrates a stitchery stand and frame assembly 10 in accordance with this invention. As shown therein the assembly 10 includes a stand 12 and a frame unit 14. Stand 12 comprises a pair of upstanding posts 16,18. The lower ends of the posts are secured together by means of a connecting unit in the form of a box assembly 20 detachably fixed to post 16 by post 16 sliding into an opening in box assembly 20. Box assembly 20 has a slot, the opening of which is indicated by the reference numeral 22. Post 18 includes a tongue 24 which is sized and shaped to snugly slide in the slot 22. A base pad 26 is provided for each post to add stability. Tongue 24 is secured to post 18 by means of block 28.

In the above manner, the distance between post 16 and 18 may be varied. For example, a basic 16 inch tongue can accommodate working frame units 14 which are from 14 to 24 inches in width. If necessary a longer tongue may be replaced which will allow larger width working frames. Thus, the connecting unit of box assembly 20 and tongue 24 provides multiple width dimensions for accommodating various frame sizes. Once a proper frame spacing between posts 16 and 18 is selected the spacing is fixed by the connection of the frame unit 14 to the posts 16,18 as later described.

The frame unit 14 comprises a working frame 30 and a mounting frame 32 secured to working frame 30 as later described.

Figure 4:
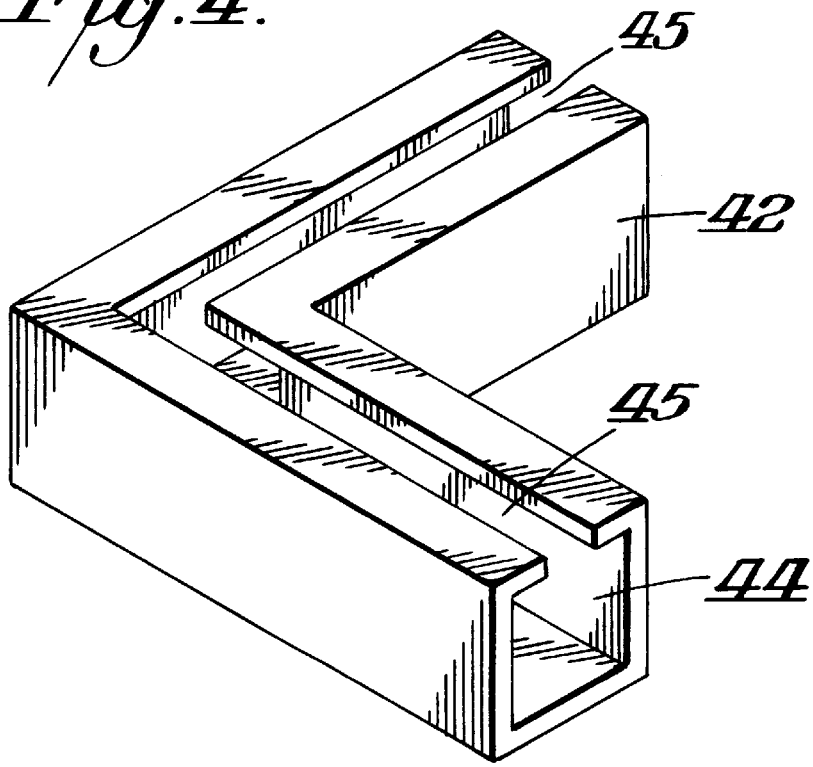
FIG. 4 is a perspective view of a corner bracket for connecting the frame member.
Figure 5:
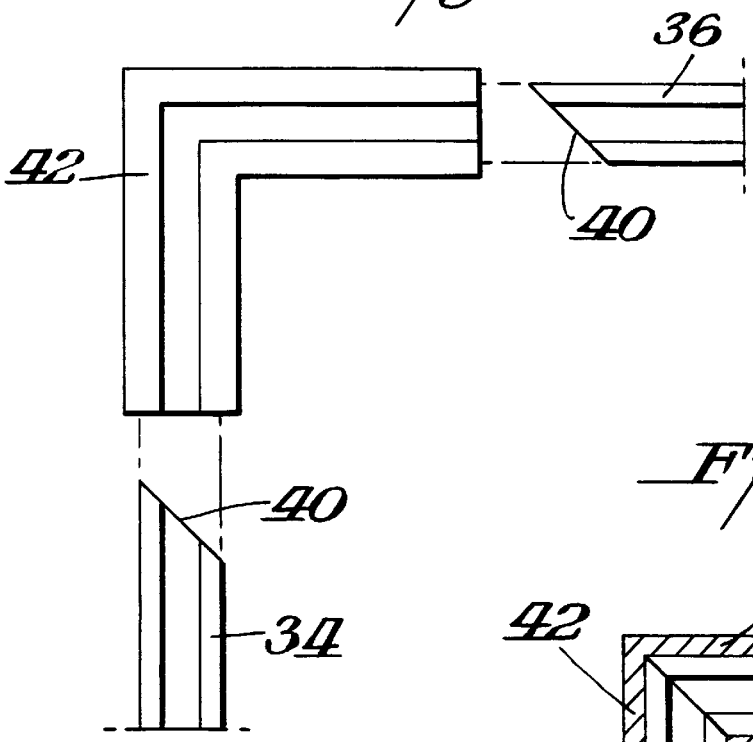
FIG. 5 is a front elevational view showing the insertion of two frame members into a corner bracket.
Figure 6:
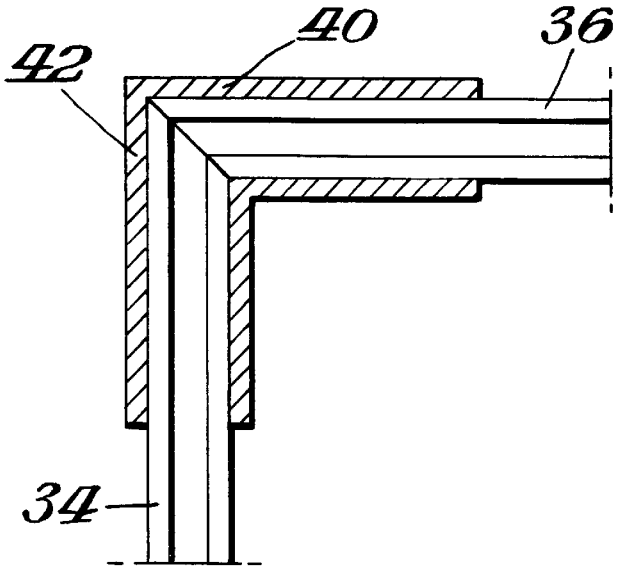
FIG. 6 is a view partly in section showing the frame members in their assembled condition in one of the corner brackets.
Figure 7:
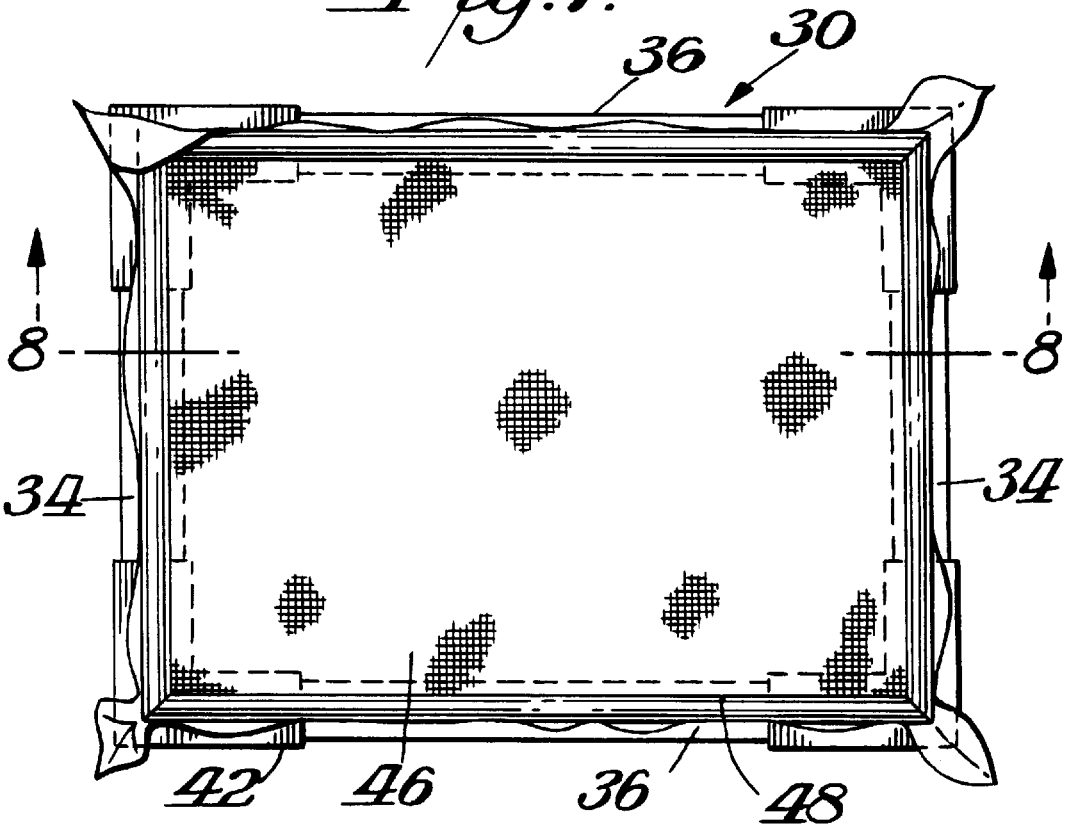
FIG. 7 is a front elevational view showing an assembled working frame with the fabric mounted therein.

FIGS. 2–8 illustrate the principle of forming the working frame 30. Working frame 30 would include a pair of spaced parallel side members 34,34 as shown in FIG. 7. The working frame 30 further includes a pair of spanning members 36,36. Each member 34,36 has a groove 38 in its exposed surface. In the preferred embodiment shown in FIGS. 2–8, the end of each member 34,36 is beveled at 45° as indicated by the reference numeral 40. The various frame members are secured together by a unique corner connector 42 best shown in FIG. 4. Corner connector 42 is an L-shaped bracket having a channel 44 with its upper surface having a slot or opening 45 in line with the groove 38 when the members 34,36 are inserted into corner bracket 42. [Although FIG. 4 illustrates corner bracket 42 to be of square cross section, preferably bracket 42 is of rectangular cross section with the top and bottom walls longer than the side walls.] FIG. 5, for example, illustrates a side member 34 and a spanning member 36 being inserted into a respective leg of the L of the corner bracket until the beveled ends 40 meet as shown in FIG. 6. A working frame may thus be formed from one sub-unit by inserting both side members and one of the spanning members into two of the corner brackets. The remaining spanning member is inserted into the remaining two of the corner brackets to form another sub-unit. The two sub-units are joined by inserting the free end of the side member 34 of the first sub-unit into the appropriate channels of the corner brackets in the second sub-unit thereby forming a completed working frame as illustrated in FIG. 7.

A working frame formed in the above manner permits different size members 34,36 to be used so that the sides of the resulting working frame can be varied by, for example, using different combinations of side members with spanning members. Thus, the versatile adjustable frame width structure works in combination with the box assembly 20 and tongue 24 to accommodate various sizes of frames.

Figure 8:
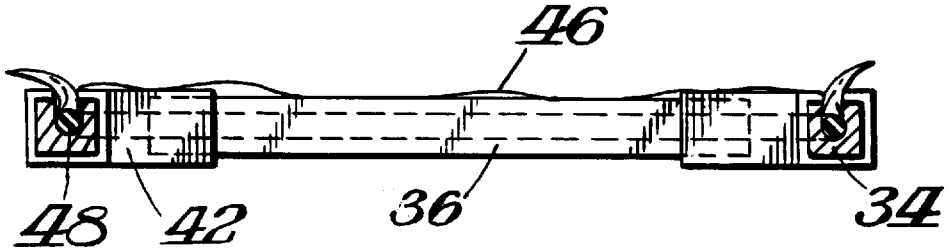
FIG. 8 is a cross-sectional view taken through FIG. 7 along the line 8—8.

Once a working frame 30 is assembled, the fabric 46 is next mounted to the frame. FIGS. 7-8 illustrate the edges of the fabric 46 to be pushed into the resulting peripheral groove which is formed by the mating of grooves 38 of the frame members and accommodated by the slot 45 of the corner brackets. The fabric is anchored in the groove periphery by means of resilient splines 48 pushed into the fabric covered groove 38 of the members 34,36. See, FIG. 8. The spline 48 function to tightly secure the fabric 46 to the working frame.

Figure 9:
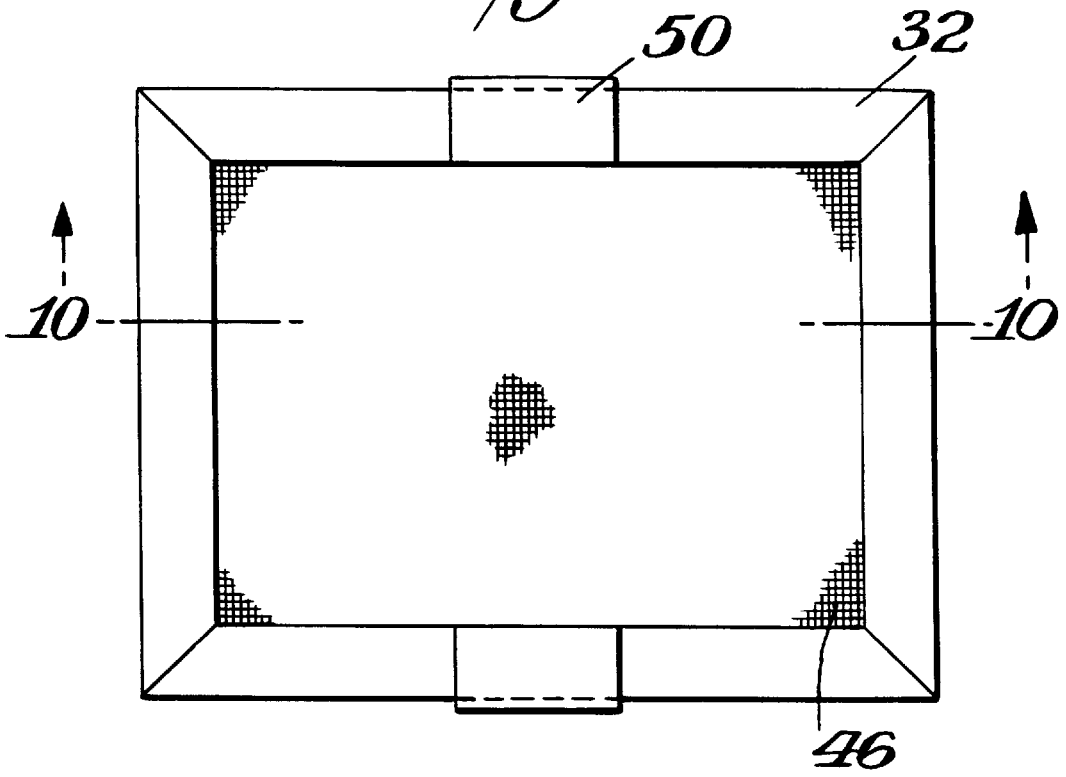
FIG. 9 is a front elevational view showing a frame unit which includes a mounting frame secured to the working frame.
Figure 10:
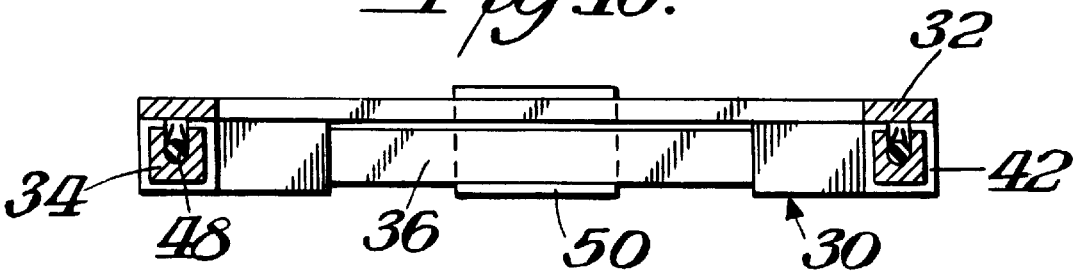
FIG. 10 is a cross-sectional view taken through FIG. 9 along the line 10—10.
Figure 11:
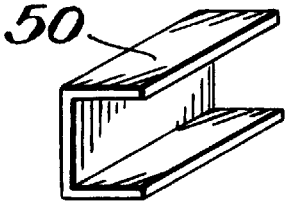
FIG. 11 is a perspective view of a mounting clip used in the frame unit shown in FIGS. 9-10.

After the fabric has been securely mounted in a taut manner to the working frame 30, a mounting frame 32 is provided as shown in FIGS. 9-10. Facing or mounting frame 32 may be composed of four mitered sections which could be joined by wood glue and stapled together for added support. The mounting frame 32 has a dual purpose. One purpose is that after the fabric is mounted and secured to the working frame 30, the mounting frame 32 is added for cosmetic purposes by concealing the grooves/slots/fabric edges/splines. Another purpose of mounting frame 32 is that when the stitchery is completed on the fabric and removed from the working frame, the stitchery could be secured to the mounting frame with staples or other suitable fasteners and prepared for final picture framing. If desired, for aesthetic purposes the mounting frame 32 could be inverted 180° so that the fabric is secured to the outer surface of the mounting frame 32. The feature of using the mounting frame for the fabric eliminates the cost of dry cleaning and stretching of the finished piece.

As shown in FIGS. 9-10, as well as FIG. 1, the working frame and mounting frame are secured together by means of U-shaped spring clip 50 which snaps over the mounting frame and working frame. The opening of the U-faces the center of the frame unit. Preferably a pair of clips 50 is used.

As shown in phantom in FIG. 1 the clip 50 may also be used to mount a design 51 to the frame unit between working frame 30 and mounting frame 32 so that the user has the design or intended pattern readily in view. The clip 50 thus provides a ready manner of quickly and easily assembling the mounting frame and working frame together and also providing the option of securing a design to the resulting frame unit.

Figure 12:
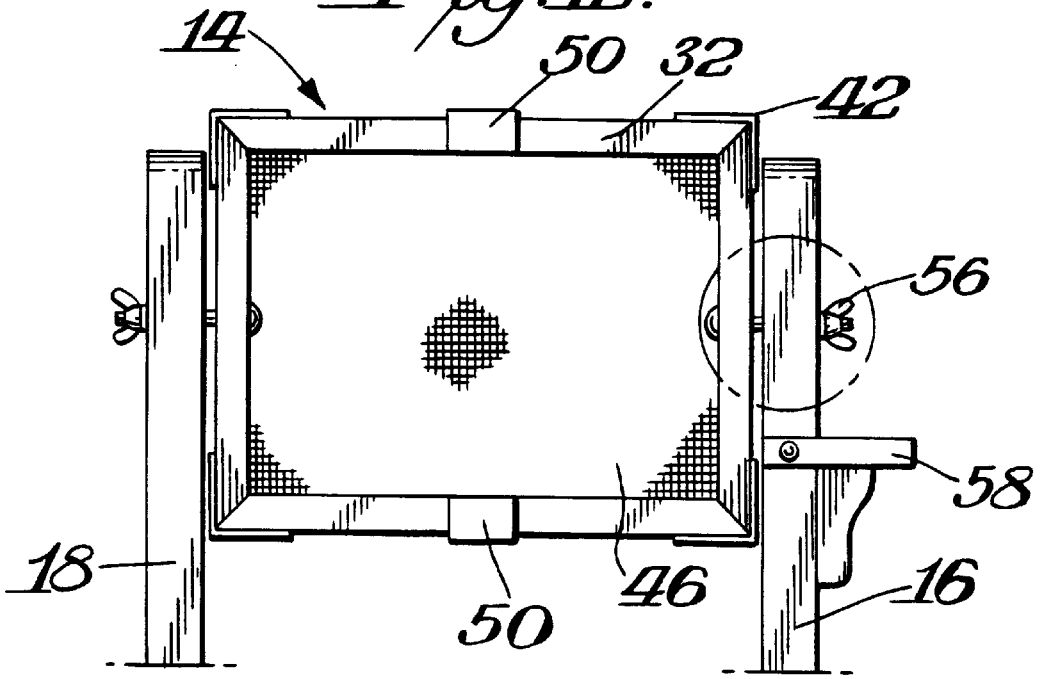
FIG. 12 is a front elevational view showing the frame unit mounted to the stand.
Figure 13:
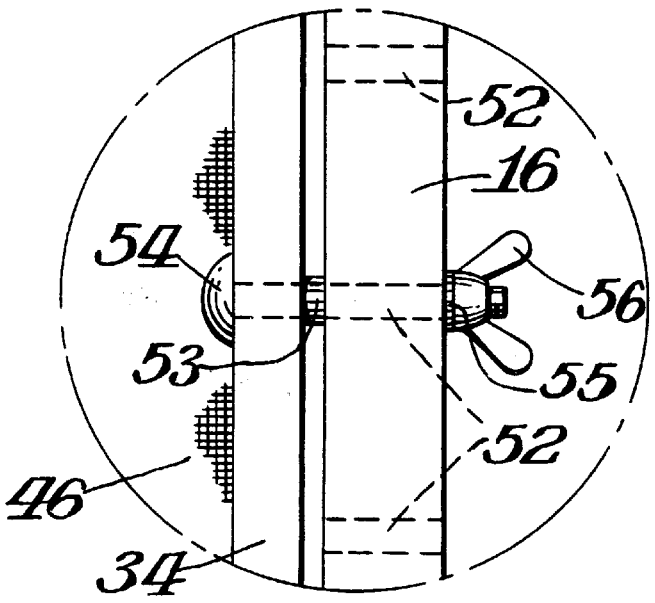
FIG. 13 is an enlarged elevational view of the circled portion of FIG. 12.

Once the frame unit 14 has been assembled the frame unit is mounted to the stand. FIGS. 12-13 best illustrate such mounting. As shown in FIG. 13 each post includes a series of holes or passageways 52. In the illustrated embodiment three such passageways 52 are shown. A fastener such as a bolt 54 is inserted through a hole in a side member 34 and then through spacer 53 and one of the holes 52 of its post 16. A similar mounting arrangement would be used for post 18. A nut 56 is then secured to the exposed end of bolt 54 over a spacer 55 to mount the frame unit 14 to the stand 12. Spacer 53 is preferably made of rubber to also provide tension when nut 56 is tightly secured to assure a firm assembly. This form of mounting also permits the angular orientation of the frame unit to be infinitely adjusted over a complete 360° circle. Such swivel option provides the user with the ability to adjust the orientation of the frame unit as best fits the user and provides the option to have ready access to the back of the fabric. Because the spacing between the lower ends of posts 16 and 18 is adjustable by the tongue 24 sliding in box assembly 20 it is possible to use a wide variety of frame unit widths for assembly 10. It is to be understood that while the use of a sliding tongue in the slot of box assembly is the preferred practice of this invention, other adjustable connecting arrangements may be used in the practice of this invention. For example, the connecting unit could simply include a slat extending from each post, with the slats slidably mounted against each other.

A further feature of this invention is the provision of a support bracket 58 mounted to at least one of the posts, such as post 16. Support bracket 58 could be used for mounting a lamp or for mounting any other desired object.

As previously indicated one unique feature of the invention is the use of corner brackets 42 which permit the ready assembly and disassembly of the frame members. By providing a continuous slot 45 in the bracket 42, there is direct access to the peripheral groove 38 that results from the abutting working frame members 34,36. A fabric could thus be easily mounted by, for example, cutting the fabric one inch longer than the working frame. Accordingly, if a frame size of 12 inches by 14 inches were used, the fabric size would be 13 inches by 15 inches. The fabric would be mounted by folding the cloth one inch on each of two adjacent sides and placing the fold in the groove 38. Next, the user would press in the spline 48 with a spline roller. The fabric would be held taut as the user continues to secure the spline on the remaining sides. The frame unit 14 would then be completed by securing the facing or mounting frame 32 to the working frame 30 through use of clips 50 which could be made of any suitable material such as plastic. After completion of the stitchery, the user removes the mounting frame and completed stitchery from the working frame. The fabric is centered on the mounting frame and stapled securely on the opposite side or secured in any other suitable manner. The completed stitchery is then ready for a decorative frame. In this manner, cleaning, stretching and mounting costs are eliminated.

Figure 14:
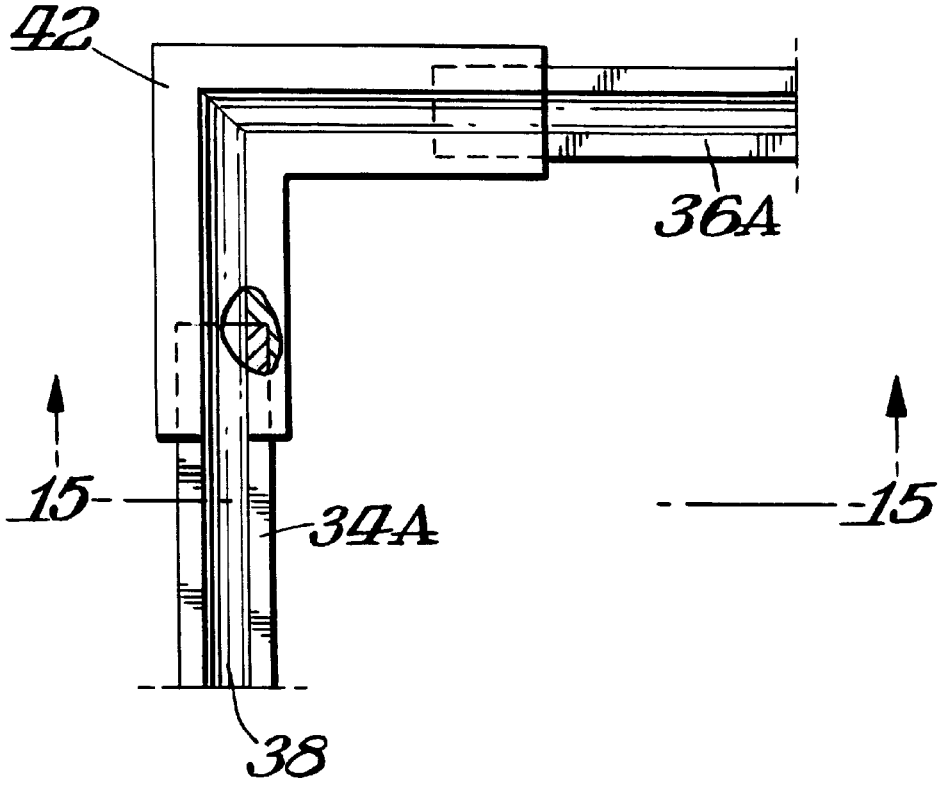
FIG. 14 is a front elevational view of a portion of a modified form of frame members mounted in a corner bracket.
Figure 15:
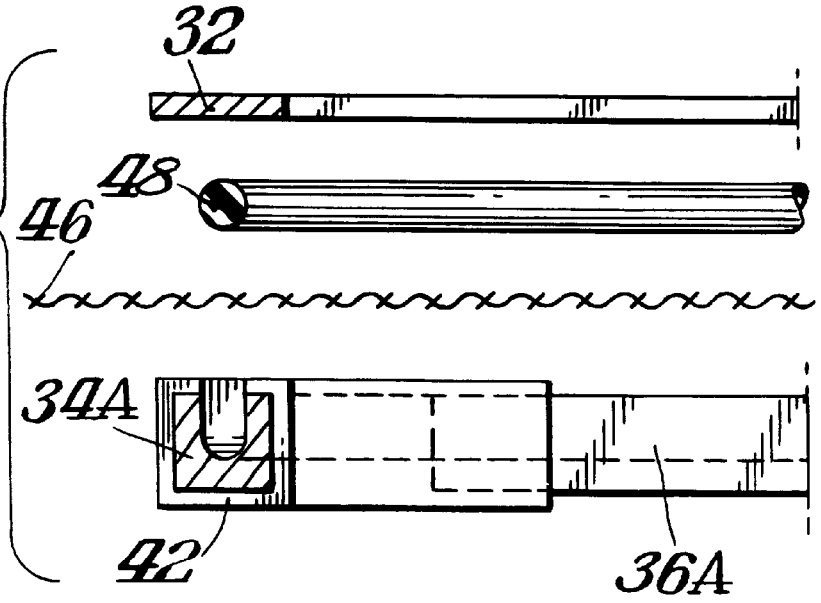
FIG. 15 is a cross-sectional exploded view of FIG. 14 taken along the line 15—15.

FIGS. 14-15 show an alternative form of structure for a working frame. As shown therein instead of having side members and spanning members with beveled faces, the side members 34A and spanning members 36A have straight edges. In the completed assembly the members would be mounted into the connector bracket 42 but there would be a gap at the corner of the frame. Accordingly, while the arrangement of FIGS. 14-15 eliminates the need for having mated bevels, it is not as preferable because it does not result in a continuous peripheral groove.

Figure 16:
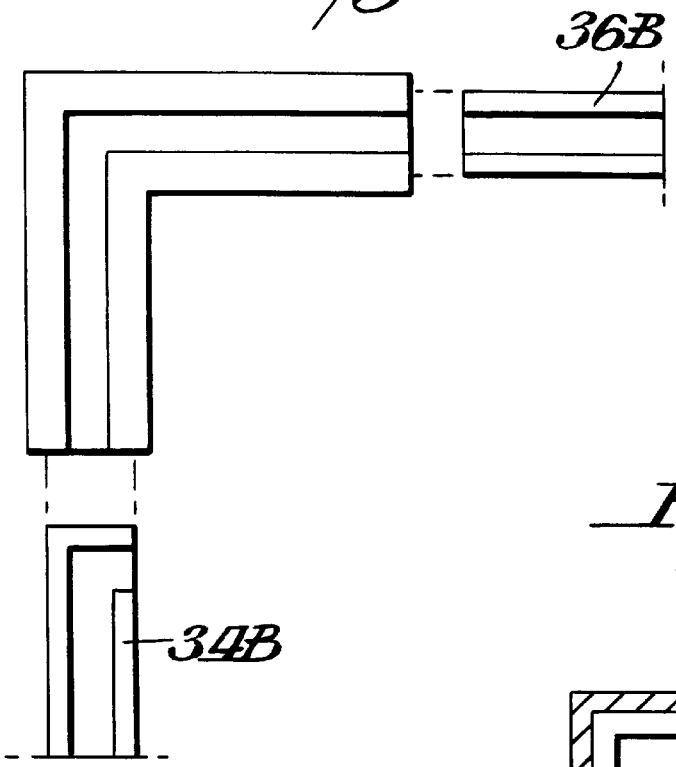
FIG. 16 is a front elevational view of a portion of still yet another form of frame members being mounted in a corner bracket.
Figure 17:
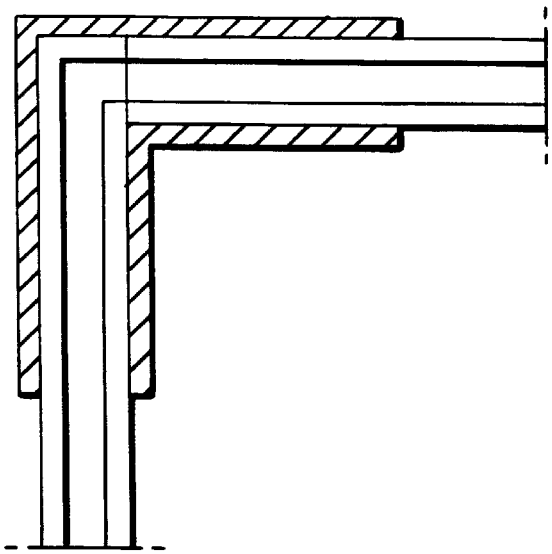
FIG. 17 is a front elevational view partly in section showing the members of FIG. 16 in their mounted condition.

FIGS. 16-17 illustrate a variation wherein the end of side member 34B includes a right angle bend so that its groove will meet the groove of spanning member 36B.

The embodiment illustrated in FIGS. 14-15 and 16-17 are included herein to make clear that the invention may be practiced with various modifications. In all of these embodiments of the invention there is a substantially continuous peripheral groove.

As can be appreciated the invention thus results in a stitchery stand and frame assembly that is vertically and horizontally adjustable to accommodate various size working frames. When attached to the stand posts, the frame unit is able to move pivotally to any desired orientation. The unique design of the invention cosmetically complements the sturdy and stable working station. The stand and frame are easily assembled and when disassembled the parts are compact for shipping and storage. The disassembly could include removing post 16 from box assembly 20 and, if desired, removing tongue 24 from block 28 to assure the components being in a compact storage/shipping condition.

What is claimed is:

1. A stitchery stand and frame assembly comprising a stand having a pair of spaced posts having upper and lower ends, a connecting unit connecting said lower ends of said posts together, a frame unit mounted between and connected to said upper ends of said posts, said frame unit including a working frame having a pair of spaced parallel side members disposed adjacent to said posts, said working frame further having a pair of spaced parallel spanning members between said side members, corner connectors detachably securing each set of adjacent side member and spanning member together to form four corners of said working frame, said working frame including fabric mounting structure for mounting a piece of fabric across said side members and said spanning members, said connecting unit comprising a box assembly secured to one of said posts, a tongue secured to other of said posts, said tongue being slidably mounted to said box unit for varying the distance between said posts, and each of said corner connectors being a channel L-shaped corner bracket for slidably receiving a respective one of said members in a respective leg of the L.

2. The assembly of claim 1 wherein said fabric mounting structure comprises a groove in each of said members, and a peripheral slot in each of said corner brackets in communication with said grooves to form a substantially continuous peripheral groove around said working frame into which said fabric is inserted.

3. The assembly of claim 2 including a spline mounted in said substantially peripheral groove against said fabric.

4. The assembly of claim 3 wherein said frame unit further includes a mounting frame mounted against said working frame.

5. The assembly of claim 4 wherein at least one spring clip is mounted around said working frame and said mounting frame to secure said working frame and said mounting frame together.

6. The assembly of claim 5 wherein said spring clip is U-shaped with the opening of the U facing toward the center of said frame unit.

7. The assembly of claim 6 wherein said mounting frame comprises means for supporting and having the fabric attached thereto after the stitchery has been completed and said mounting frame and said fabric are detached from said working frame.

8. The assembly of claim 7 wherein each of said members has a beveled end, and said beveled end of adjacent members abutting against each other to form a continuous peripheral groove.

9. The assembly of claim 7 wherein the ends of said frame members are spaced from each other.

10. The assembly of claim 7 wherein said frame unit is pivotally mounted to said posts to permit the orientation of said frame unit with respect to said posts to be varied.

11. The assembly of claim 10 including a support bracket mounted to at least one of said posts for holding a lamp or the like.

12. The assembly of claim 11 wherein said frame unit is pivotally mounted by a fastener extending through aligned holes in said side member and said post for each set of said side members and posts.

13. The assembly of claim 12 wherein each of said posts includes a plurality of holes for selective alignment with the hole of said side member to provide height adjustability for said mounting of said frame unit.

14. The assembly of claim 13 wherein said box assembly includes a longitudinal slot, and said tongue slidably mounted in said slot.

15. The assembly of claim 14 including base pad secured to and extending outwardly from said lower ends of said posts for providing stability to said stand.

16. A stitchery stand and frame assembly comprising a stand having a pair of spaced posts having upper and lower ends, a connecting unit connecting said lower ends of said posts together, a frame unit mounted between and connected to said upper ends of said posts, said frame unit including a working frame having a pair of spaced parallel side members disposed adjacent to said posts, said working frame further having a pair of spaced parallel spanning members between said side members, corner connectors detachably securing each set of adjacent side member and spanning member together to form four corners of said working frame, said working frame including fabric mounting structure for mounting a piece of fabric across said side members and said spanning members, said connecting unit comprising a box assembly secured to one of said posts, a tongue secured to other of said posts, said tongue being slidably mounted to said box unit for varying the distance between said posts, said box assembly including a longitudinal slot, said slot being dimensioned to snugly receive said tongue, and said tongue slidably mounted in said slot and being surrounded by said box assembly.

17. The assembly of claim 16 including a support bracket mounted to at least one of said posts for holding an object.

18. The assembly of claim 16 wherein said frame unit is pivotally mounted to said post to permit the orientation of said frame unit with respect to said posts to be varied.

19. The assembly of claim 16 wherein said frame unit is mounted to said posts by a fastener extending through aligned holes in a respective set of a side member and post, and each of said posts having a plurality of holes for selective alignment with the hole of said side member for providing height adjustability.

20. The assembly of claim 16 including a base pad under each of said posts extending transversely to the direction of orientation of said box assembly and said tongue, one of said base pads secured to said box assembly, and the other of said base pads being secured to said post to which said tongue is secured for stabilizing said assembly.

21. A stitchery stand and frame assembly comprising a stand having a pair of spaced posts having upper and lower ends, a connecting unit connecting said lower ends of said posts together, a frame unit mounted between and connected to said upper ends of said posts, said frame unit including a working frame having a pair of spaced parallel side members disposed adjacent to said posts, said working frame further having a pair of spaced parallel spanning members between said side members, corner connectors detachably securing each set of adjacent side member and spanning member together to form four corners of said working frame, and said working frame including fabric mounting structure for mounting a piece of fabric across said side members and said spanning members, and each of said corner connectors being a channel L-shaped corner bracket for slidably receiving a respective one of said members in a respective leg of the L.

22. The assembly of claim 21 wherein said connecting unit comprises a box assembly secured to one of said posts, a tongue secured to other of said posts, and said tongue being slidably mounted to said box unit for varying the distance between said posts.

23. The assembly of claim 21 wherein each of said members has a beveled end, and said beveled end of adjacent members abutting against each other.

24. The assembly of claim 21 wherein said fabric mounting structure comprises a groove in each of said members and a peripheral slot in each of said corner brackets in communication with said grooves to form a substantially continuous peripheral groove around said working frame into which said fabric is inserted.

25. The assembly of claim 24 including a spline mounted in said substantially peripheral groove against said fabric.

26. A stitchery stand and frame assembly comprising a stand having a pair of spaced posts having a upper and lower ends, a connecting unit connecting said lower ends of said posts together, a frame unit mounted between and connected to said upper ends of said posts, said frame unit including a working frame having a pair of spaced parallel side members disposed adjacent to said posts, said working frame further having a pair of spaced parallel spanning members between said side members, corner connectors detachably securing each set of adjacent side member and spanning member together to form four corners of said working frame, said working frame including fabric mounting structure for mounting a piece of fabric across said side members and said spanning members, said frame unit further including a mounting frame mounted against said working frame, said working frame side members and spanning members being connected together to form a continuous peripheral structure having an open central area, said mounting frame comprising two side members and two spanning members connected together to form a continuous peripheral structure having an open central area, each of said peripheral structures of said working frame and said mounting frame having a front face and a rear face, said fabric mounting structure being on said front face of said working frame, said fabric securing structure detachably mounting a fabric to said working frame, said rear face of said mounting frame being toward said front face of said working frame and covering said fabric securing structure, and said working frame and mounting frame being detachably mounted together whereby a fabric may be detached from said working a frame and secured to said mounting frame for creating a framed unit from said mounting frame and the fabric.

27. The assembly of claim 26 wherein at least one spring clip is mounted around said working frame and said mounting frame to secure said working frame and said mounting frame together.

28. A stitchery stand and frame assembly comprising a stand having a pair of spaced posts having upper and lower ends, a connecting unit connecting said lower ends of said posts together, a frame unit mounted between and connected to said upper ends of said posts, said frame unit including a working frame having a pair of spaced parallel side members disposed adjacent to said posts, said working frame further having a pair of spaced parallel spanning members between said side members, corner connectors detachably securing each set of adjacent side member and spanning member together to form four corners of said working frame, said working frame including fabric mounting structure for mounting a piece of fabric across said side members and said spanning members, said frame unit further including a mounting frame mounted against said working frame, at least one spring clip being mounted around said working frame and said mounting frame to secure said working frame and said mounting frame together, and said spring clip being U-shaped with the opening of the U facing toward the center of said frame unit.

29. A stitchery stand and frame assembly comprising a stand having a pair of spaced posts having upper and lower ends, a connecting unit connecting said lower ends of said posts together, a frame unit mounted between and connected to said upper ends of said posts, said frame unit including a working frame having a pair of spaced parallel side members disposed adjacent to said posts, said working frame further having a pair of spaced parallel spanning members between said side members, corner connectors detachably securing each set of adjacent side member and spanning member together to form four corners of said working frame, said working frame including fabric mounting structure for mounting a piece of fabric across said side members and said spanning members, said fabric mounting structure comprising a groove in each of said members and a peripheral slot in each of said corner connectors in communication with said grooves to form a substantially continuous peripheral groove around said working frame into which said fabric is inserted, and including a spline mounted in said substantially peripheral groove against said fabric.

30. A method of assembling a stitchery stand and frame assembly comprising mounting the lower ends of a pair of stand posts together by sliding a tongue secured to one post into the slot of a box assembly secured to the other post, forming a working frame by mounting working frame side members and spanning members into four corner brackets with each of the frame members having a groove to form a substantially peripheral groove, mounting a fabric into the substantially peripheral groove, inserting a spline into the groove, securing a mounting frame to the working frame by at least one clip fastened over the mounting frame and working frame to thereby form a frame unit, and securing the frame unit to the posts for fixing the spacing between the posts.

31. The method of claim 30 including detaching the mounting frame and fabric from the working frame, and securing the fabric to the mounting frame.

32. The method of claim 31 including mounting a design under the clip while the mounting frame and working frame are secured together by the clip.

33. The method of claim 30 wherein the frame unit is pivotally mounted to the posts.

34. The method of claim 30 wherein the frame unit is mounted to the posts at one of a number of selected heights.

35. The method of claim 30 including replacing the frame unit with a different frame unit of different width, and adjusting the spacing between the lower ends of the posts by means of the tongue sliding in the box assembly.

36. The method of claim 30 wherein each of the working frame members has a beveled end, and sliding the members into the corner brackets until the beveled ends abut each other.

* * * * *